United States Patent [19]

French et al.

[11] 4,118,070

[45] Oct. 3, 1978

[54] SUBTERRANEAN IN SITU OIL SHALE RETORT AND METHOD FOR MAKING AND OPERATING SAME

[75] Inventors: Gordon B. French; Richard D. Ridley, both of Bakersfield, Calif.

[73] Assignee: Occidental Oil Shale, Inc., Grand Junction, Colo.

[21] Appl. No.: 837,031

[22] Filed: Sep. 27, 1977

[51] Int. Cl.[2] ..... E21B 43/24; E21B 43/26; E21C 41/10

[52] U.S. Cl. ..... 299/2; 166/259; 166/251; 299/19

[58] Field of Search ..... 299/2, 19; 166/256, 166/259, 302, 315, 285, 292

[56] References Cited

U.S. PATENT DOCUMENTS

| | | | |
|---|---|---|---|
| 2,481,051 | 9/1949 | Uren | 299/2 |
| 2,801,089 | 7/1957 | Scott, Jr. | 299/2 |
| 3,017,168 | 1/1962 | Carr | 299/2 |
| 3,233,668 | 2/1966 | Hamilton et al. | 166/259 |
| 3,950,029 | 4/1976 | Timmins | 299/2 |
| 4,018,280 | 4/1977 | Daviduk et al. | 299/2 X |
| 4,022,511 | 5/1977 | French | 299/2 |
| 4,043,595 | 8/1977 | French | 299/2 |
| 4,043,596 | 8/1977 | Ridley | 299/2 |
| 4,043,597 | 8/1977 | French | 299/2 |

*Primary Examiner*—Stephen J. Novosad

*Attorney, Agent, or Firm*—Christie, Parker & Hale

[57] ABSTRACT

An in situ oil shale retort is formed in a subterranean formation containing oil shale. The retort contains a fragmented permeable mass of particles containing oil shale. An open base of operation is excavated in the formation at an elevation above the fragmented mass to be formed, and an access drift is excavated to provide access to the bottom of the retort site. Formation is explosively expanded to form the fragmented mass between the access drift and an elevation spaced below the bottom of the base of operation, leaving a horizontal sill pillar of unfragmented formation between the top of the fragmented mass and the bottom of the base of operation. The sill pillar provides a safe base of operation above the fragmented mass after it is formed. The fragmented mass is formed by, among other steps, drilling blasting holes from the base of operation down through the sill pillar and then detonating explosive in such holes to form the fragmented mass of particles in the retort below the sill pillar. During retorting, gas is introduced into the fragmented mass through such blasting holes for establishing a combustion zone in the fragmented mass and for advancing the combustion zone through the fragmented mass. The blasting holes have separate valves located in the base of operation for use in controlling gas flow through selected regions of the fragmented mass.

23 Claims, 4 Drawing Figures

SUBTERRANEAN IN SITU OIL SHALE RETORT AND METHOD FOR MAKING AND OPERATING SAME

BACKGROUND OF THE INVENTION

This application is related to U.S. Patent Application Ser. No. 603,704 entitled "In Situ Recovery of Shale Oil", filed Aug. 11, 1975 by Gordon B. French, now U.S. Pat. No. 4,043,595, to U.S. Pat. Application Ser. No. 603,705 entitled "Forming Shale Oil Recovery Retort Into Slot-Shaped Columnar Void", filed Aug. 11, 1975, by Richard D. Ridley, now U.S. Pat. No. 4,043,596, and to U.S. Patent Application Ser. No. 790,350 entitled "In Situ Oil Shale Retort With a Horizontal Sill Pillar" filed Apr. 25, 1977, by Ned M. Hutchins. All three of these applications are assigned to the assignee of the present application and are incorporated herein by this reference.

This invention relates to recovery of liquid and gaseous products from oil shale. The term "oil shale" as used in the industry is in fact a misnomer; it is neither shale, nor does it contain oil. It is a sedimentary formation comprising marlstone deposit with layers containing an organic polymer called "kerogen" which upon heating decomposes to produce hydrocarbon liquid and gaseous products. The formation containing kerogen is called "oil shale" herein, and the hydrocarbon liquid product is called "shale oil".

One technique for recovering shale oil includes forming an in situ oil shale retort in a subterranean formation containing oil shale. At least a portion of the formation within the boundaries of the in situ oil shale retort is explosively expanded to form a fragmented permeable mass of particles containing oil shale. The fragmented mass is ignited near the top of the retort to establish a combustion zone. An oxygen-containing gas is introduced into the top of the retort to sustain the combustion zone and cause it to move downwardly through the fragmented permeable mass of particles in the retort. As burning proceeds, the heat of combustion is transferred to the fragmented mass of particles below the combustion zone to release shale oil and gaseous products therefrom in a retorting and vaporization zone. Vaporized constituuents of shale oil, water vapor and the like may condense on cooler oil shale in the retort below the retorting zone. The retorting zone moves from top to bottom of the retort ahead of the combustion zone, and the resulting shale oil and gaseous products pass to the bottom of the retort for collection and removal. Recovery of liquid and gaseous products from oil shale deposits is described in greater detail in U.S. Pat. No. 3,661,423, to Donald E. Garrett, assigned to the assignee of this application.

In preparing for the retorting process the formation containing oil shale should be fragmented rather than simply fractured to create good and uniform permeability so that undue pressures are not required to pass the gas through the retort, and so that valuable deposits of oil shale are not bypassed owing to non-uniform permeability. The aforementioned patent applications disclose techniques for fragmenting a substantial volume of formation in a retort site to form a fragmented mass of particles in an in situ oil shale retort. The in situ retort is formed by excavating a void in the retort site, drilling blasting holes into the remaining portion of the formation in the retort site, loading explosive into the blasting holes, and detonating the explosive to expand the formation toward the void.

To promote maximum uniformity of particle size and permeability of the fragmented mass, and to minimize the quantity of explosives, the blasting holes should be reasonably accurately located with respect to each other, and with respect to the void toward which expansion occurs during the explosion. Oil shale formations in the western United States are often between 50 to about 500 feet thick or even more, and are covered by a non-productive overburden, which may be thousands of feet deep, thus often making it difficult to drill from the surface and accurately locate blasting holes in the oil shale formation.

In one embodiment disclosed in application Ser. No. 790,350, entitled "In Situ Oil Shale Retort With a Horizontal Sill Pillar", an open base of operation is excavated in the new formation at a working level near the top of an in situ retort to be formed, which may be a thousand feet, or more, below the ground surface. A substantially horizontal access drift is excavated at a production level below the base of operation to provide access to a lower portion of the retort site. A void is excavated above the access drift so the void opens into the access drift and terminates below the base of operation at the top of the fragmented mass being formed. This leaves a substantially horizontal portion of unfragmented formation between the top of the void and the bottom of the base of operation. Blasting holes for explosive for expanding formation are drilled from the base of operation into a portion of the formation within the boundaries of the retort being formed. Inasmuch as the working level is much closer to the top of the retort being formed than the distance from the retort through the overburden to the ground surface, this permits more accurate and rapid drilling of blasting holes from the base of operation than from the ground surface. This, in turn, facilitates explosive expansion to form the fragmented mass of oil shale particles in the retort. Explosive is loaded into such blasting holes and detonated for explosively expanding formation towards such a void for forming a fragmented permeable mass of particles containing oil shale in the retort.

In an embodiment disclosed in Application Ser. No. 790,350 entitled "In Situ Oil Shale Retort With a Horizontal Sill Pillar", a horizontal sill pillar of unfragmented formation remains between the top of the fragmented mass in the retort and the bottom of the base of operation. The sill pillar has a number of bore holes through it after formation of the fragmented mass. Such bore holes include the upper ends of blasting holes drilled from the base of operation. Such bore holes can be used for access from the base of operation for establishing and sustaining a combustion zone in the fragmented mass below the sill pillar.

U.S. Pat. No. 3,661,423 to Garrett discloses an in situ oil shale retort in which communication is established with the top of an expanded oil shale deposit by drilling a plurality of communicating conduits to the top of the expanded shale. A source of oxygen from a compressor is then provided to the conduits. To establish a flow of oil from the shale, the upper level of the expanded shale deposit is ignited using an initial supply of fuel and air to the top of the shale deposit through the conduits. A source of oxygen is supplied at a pressure sufficient to overcome the inherent pressure drop through the conduits and the shale deposit to establish a positive downward flow of hot gases.

U.S. Patent Application Ser. No. 716,583, entitled "Method For In Situ Recovery of Liquid and Gaseous Products From Oil Shale Deposits", filed on Aug. 23, 1976, by Gordon B. French, and assigned to the assignee of this application, discloses an in situ oil shale retort in which a plurality of air supply holes, or passages, are drilled from a tunnel to distributed locations at the top retort. One of the air supply holes can extend directly down from the tunnel to the center of the top portion of the fragmented mass in the retort. The other air inlet holes slope from the overlying tunnel to the top portion of the retort near the corners. The air supply holes have diameters of 4 to 7 feet for minimizing pressure losses. The effective sizes of the holes overlying paths through the retort can be selectively changed as by adjusting louvers within such holes.

U.S. Pat. No. 2,481,051 to Uren discloses a plurality of vertical pipes installed through broken shale extending from a lower level to an upper level in an in situ oil shale retort. At the upper end of each pipe a lateral connection is provided for the introduction of compressed air. Compressed air is introduced through an inlet line and then through the lateral connections to the upper end of each of the pipes.

It can be desirable to use the base of operation as a working level from which to control formation of a fragmented mass in an in situ oil shale retort and from which to subsequently regulate the flow of gas through the fragmented mass. By providing separate gas flow control valves connected to bore holes extending through a sill pillar, the relative amounts of gas supplied to selected regions of the fragmented mass can be controlled.

Such control can inhibit non-uniform advancement of a combustion zone through the fragmented mass. By providing a relatively uniform advancement of the combustion zone, more effective retorting of the fragmented mass can be provided, which can result in a greater yield from the retort or more economical operation.

SUMMARY OF THE INVENTION

According to one practice of the invention, an in situ oil shale retort comprising a fragmented permeable mass of formation particles containing oil shale is formed in a subterranean formation containing oil shale. An open base of operation is excavated in an upper level of the formation above the fragmented mass, leaving a horizontal sill pillar of unfragmented formation between the bottom of the base of operation and the top of the fragmented mass. A plurality of bore holes are formed through the sill pillar so that they are distributed across the horizontal cross-section of the fragmented mass and open into the base of operation. A top portion of the fragmented mass below the sill pillar is ignited to establish a combustion zone for recovering liquid and gaseous products from the fragmented mass. An oxygen-containing gas is introduced to the fragmented mass through the bore holes for advancing the combustion zone through the fragmented mass. Gas flow through at least a portion of the bore holes is separately controlled from a location within the base of operation to control advancement of the combustion zone through the fragmented mass.

A separate casing can be sealed in each of a plurality of the bore holes. The upper end of each casing opens into the base of operation, and a control valve and a check valve are provided at the upper end of each casing for control from within the base of operation.

For operating the retort, gas pressure in a lower region of the fragmented mass is made lower than in the base of operation to draw air from the base of operation down through the bore holes and through the permeable mass, to advance the combustion zone downwardly through the fragmented mass.

DRAWINGS

These and other aspects of the invention will be more fully understood by referring to the following detailed description and the accompanying drawings, in which.

DESCRIPTION

General Description of Retort Forming

Figure 1:
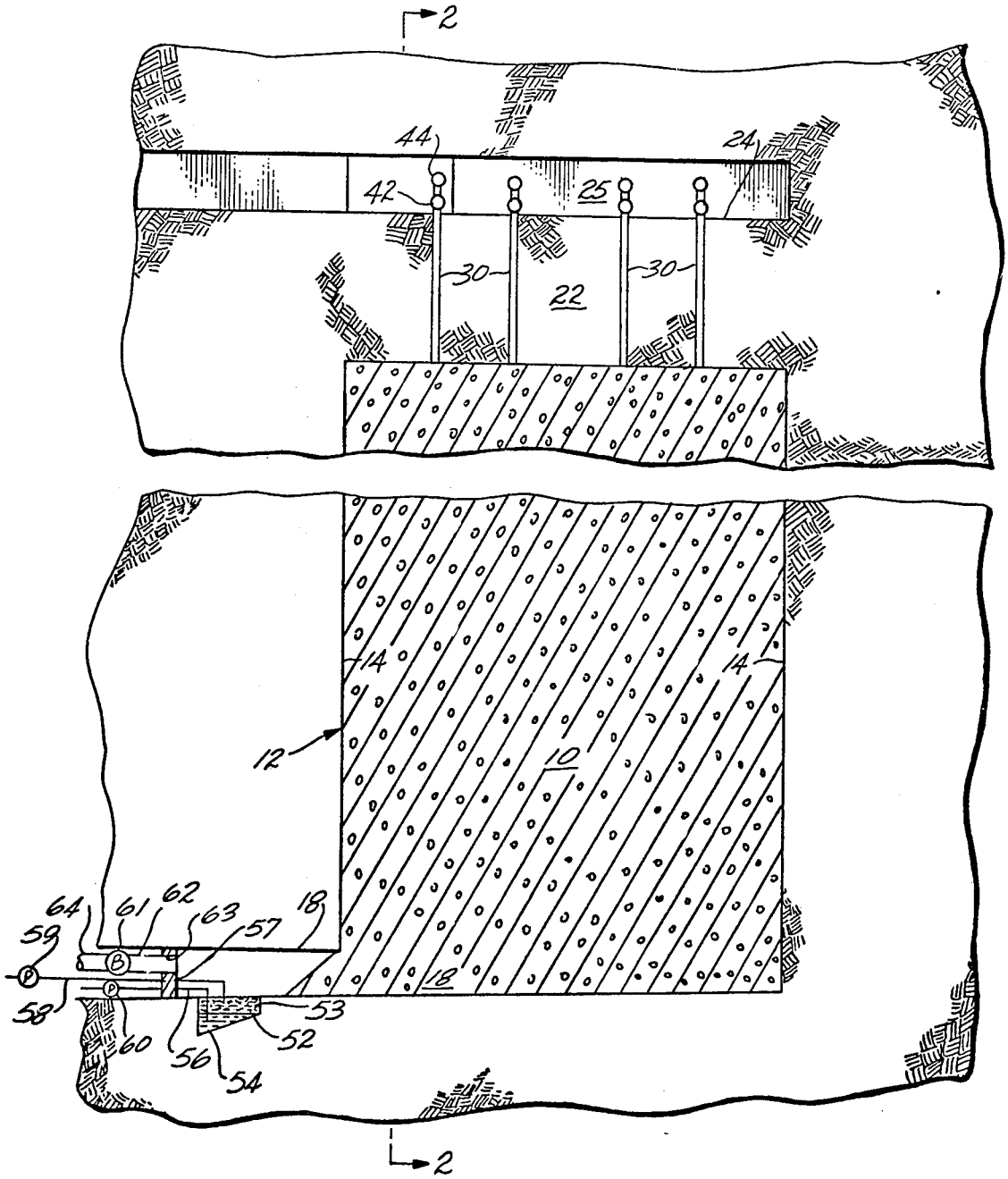
FIG. 1 is a semi-schematic vertical cross-sectional view showing one embodiment of an in situ oil shale retort.

An in situ oil shale retort has a base of operation formed on a working level in a subterranean formation. This working level is at an upper elevation near the top of a retort being formed. A fragmented permeable mass of particles containing oil shale is formed below the base of operation by exlosive expansion of formation toward an excavated void. The bottom of the base of operation is separated from the top boundary of the fragmented mass by a horizontal sill pillar of unfragmented formation. The horizontal sill pillar is sufficiently thick that it withstands stresses imposed by explosive expansion, as well as geologic stresses, to provide a safe base of operation after formation of the fragmented mass. This permits men and equipment to enter the base of operation over the top of the fragmented mass after explosive expansion. The base of operation on the working level can have a horizontal extent that permits effective access over substantially the entire horizontal cross-section of the fragmented mass, which is of great assistance in forming and operating an in situ retort.

After explosive expansion the base of operation is convenient as a location from which to ignite an upper portion of the fragmented mass and to control gas flow through the fragmented mass so as to establish a combustion zone in the fragmented mass.

In one method of forming an in situ oil shale retort in a formation containing oil shale, a portion of the formation is excavated to form a base of operation on an upper working level. A drift or similar means of access is excavated through formation at a lower production level to a location underlying the base of operation at or below the bottom of the in situ retort.

In preparing such a retort, at least one void is excavated from within the boundaries of the fragmented mass being formed, the void being connected to the access drift on the production level underlying the base of operation. This leaves another portion of the formation within the boundaries of the retort being formed which is to be fragmented by explosive expansion toward such a void. Such a void is excavated only to an elevation above the access drift that leaves a horizontal sill pillar of intact formation between the top of the void and the bottom of the base of operation. The surface of the formation defining the void provides at least one free face which extends through the formation, and the remaining portion of the formation within the boundaries of the retort being formed is explosively expanded toward such a free face.

In a preferred embodiment, the horizontal extent of the base of operation over the fragmented mass in the in situ retort is sufficient to provide effective access to substantially the entire horizontal cross-section of the fragmented mass. This does not require that there be an open evcavation over the entire horizontal extent of the fragmented mass. Roof-supporting pillars can be left on the working level in a portion of the area directly above the fragmented mass. The size and arrangement of such working level pillars leaves an open base of operation having a sufficient horizontal extent to provide access to substantially the entire horizontal cross-section of the retort site. Such a base of operation facilitates excavation operations for forming a void for drilling and explosive loading for explosive expansion of formation toward such a void, and introduction of oxygen containing gas into the top of the fragmented mass below the horizontal sill pillar.

In one embodiment a plurality of vertically extending bore holes are drilled through the sill pillar into formation remaining below the sill pillar. The bore holes are sometimes referred to herein as "blasting holes" inasmuch as they are used to hold explosive for blasting the formation to form the fragmented permeable mass of particles containing oil shale. Such blasting holes can be ten inches or more in diameter. Smaller bore holes can also be present through the sill pillar. Explosive is loaded into such blasting holes from the base of operation up to a level about the same as the bottom of the horizontal sill pillar, which is to remain unfragmented. Such explosive is detonated for explosively expanding subterranean formation toward such a void below the sill pillar and forming a fragmented mass of formation particles in the retort while leaving unfragmented formation forming the sill pillar.

The base of operation can be used as a location from which to initiate and control advancement of the combustion zone through the retort.

DETAILED DESCRIPTION

Figure 2:
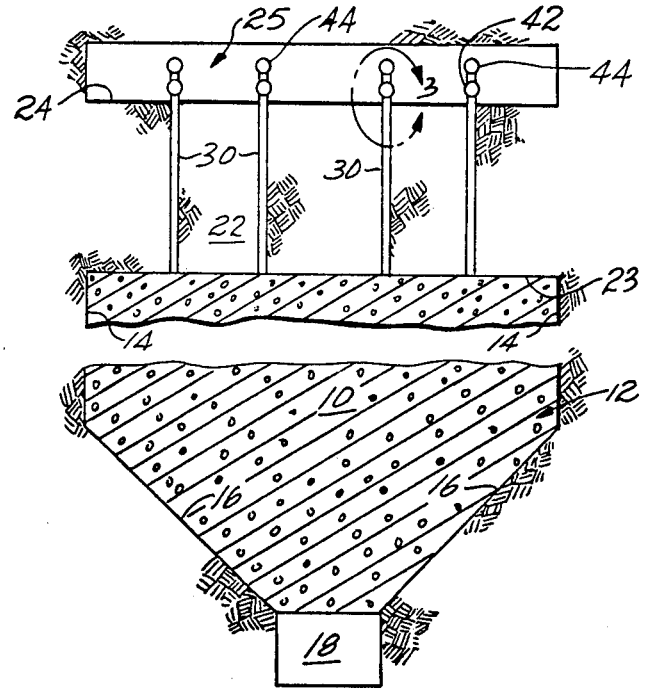
FIG. 2 is a horizontal cross-sectional view taken on line 2—2 of FIG. 1.

Referring to FIGS. 1 and 2, a fragmented permeable mass 10 of formation particles containing oil shale is in an in situ oil shale retort 12 in a subterranean formation containing oil shale. The fragmented permeable mass has vertical side boundaries 14 substantially perpendicular to each other to give the retort a rectangular horizontal cross-section. The lower boundary 16 of the fragmented permeable mass slopes downwardly and inwardly (see FIG. 2) at an angle of about 45° and opens into the top of an elongated, substantially horizontal access drift 18 at the bottom of the retort 12. The access drift 18 has a gradual slope downwardly from the center of the bottom of the retort toward a sump 52 for recovering liquid products of retorting at the production level. The fragmented permeable mass also fills the portion of the access drift beneath the retort.

A horizontal sill pillar 22 of unfragmented formation forms the upper boundary 23 of the fragmented permeable mass in the retort. The top of the sill pillar 22 forms the floor 24 of an open base of operation 25 spaced above the fragmented mass by a distance equal to the thickness of the sill pillar. In this embodiment the base of operation 25 is an excavation 12 to 14 feet high at a working level above the retort. It extends over substantially the entire horizontal cross-section of the fragmented mass and opens at the left (as viewed in FIG. 1) to other excavations at the working level used for exploiting the oil shale deposit. Such underground workings open to a vertical shaft or horizontal adit (not shown).

A plurality of vertical blasting holes 30 extend through the sill pillar. The blasting holes remain in the sill pillar after the blasting which formed the fragmented mass in the retort. The blasting holes are approximately uniformly distributed over the area of the sill pillar 22. In a working embodiment, the horizontal cross-section of the fragmented permeable mass is square, each side being about 120 feet long; and ten inch diameter blasting holes are located at intervals of about 25 feet and about 30 feet in a rectangular grid over essentially the entire horizontal cross section of the fragmented mass. Formaion of such an in situ oil shale retort is described in detail in U.S. Patent Application Ser. No. 790,350, filed Apr. 25, 1977, and entitled "In Situ Oil Shale Retort With a Horizontal Sill Pillar".

During operation of the retort, gas used for retorting of the oil shale is passed downwardly through the fragmented mass. An oxygen containing gas is introduced into an upper portion of the fragmented permeable mass from the base of operation for sustaining a combustion zone in the fragmented mass and advancing the combustion zone through the fragmented mass. Heat from the combustion zone, carried by flowing gas advances a retorting zone through the fragmented mass on the advancing side of the combustion zone. Liquid and gaseous products are retorted from oil shale in the retorting zone. The production level drift 18 provides a means for collecting and recovering liquid products and withdrawing off gas containing gaseous products from retorting oil shale in the retort 10. A variety of retorting techniques can be used, some of which are set forth in the prior art, so no further description of them is set forth herein.

Figure 3:
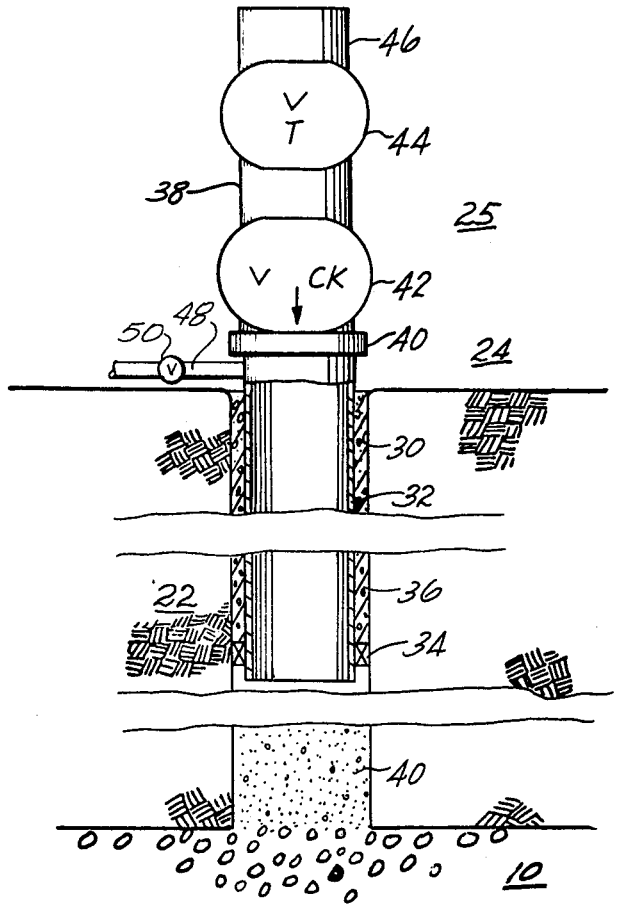
FIG. 3 is a horizontal cross-sectional plan view taken on line 3—3 of FIG. 1 showing a base of operation above a horizontal sill pillar in the in situ retort.
Figure 4:
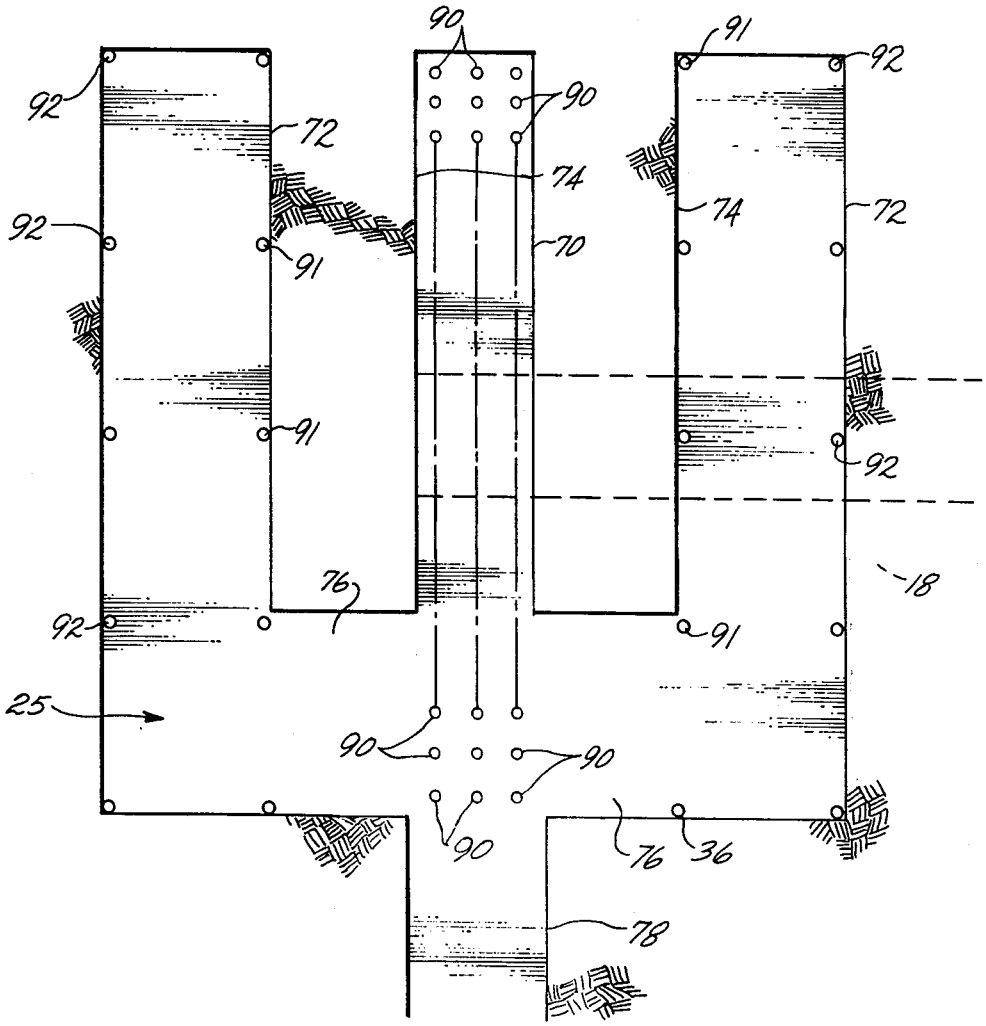
FIG. 4 is an enlarged semi-schematic cross-sectional view taken within the circle 4 of FIG. 2 and showing a casing sealed in a blasting hole extending through the sill pillar in the in situ retort.

FIG. 3 is a horizontal cross-section at the working level viewing the open base of operation 25 from above. The base of operation 25 is generally E-shaped and has a central drift 70 and a separate side drift 72 on each side of the central drift. The two side drifts are similar to each other in size and shape. Elongated roof-supporting pillars 74 of unfragmented formation separate the side drifts 72 from the central drift 70. Short crosscuts 76 interconnect the side drifts 72 and the central drift 70 to form a generally E-shaped excavation. Other arrays of drifts and roof-suppoting pillars also can be used. A branch drift 78 provides access to the base of operation 25 from underground workings (not shown) at the level of the base of operation.

After the base of operation is formed, a void in the shape of a vertically extending slot (not shown) is formed between the production level access drift 18 and an elevation spaced below the bottom of the base of operation. Blasting holes or shot holes 90 are drilled downwardly from the central drift 70 of the base of operation 25. In a working embodiment these blasting holes are about $3\frac{5}{8}$ inches in diameter. Such blasting holes are loaded with explosive which is detonated to ultimately form the slot shaped void. Particles of formation from forming the slot are excavated from the production level access drift 18. In forming the slot, the blasting holes 90 are loaded only to an elevation spaced about 40 feet below the bottom of the base of operation. In a working embodiment the thickness of the horizontal sill pillar 22 left unfragmented between the top of the slot and the bottom of the base of operation is about 40 feet. The tops of the holes 90 are stemmed to inhibit breakage into the sill pillar 22. The side walls of the void formed by the slot provide vertically extending free faces within the side boundaries of the fragmented permeable mass of particles to be formed in the in situ oil shale retort site.

After the slot is excavated, a remaining portion of the formation within the retort site is explosively expanded toward the void formed by such a slot. A plurality of blasting holes are drilled downwardly in the formation within the retort site from the side drifts 72 of the base of operation 25 on the working level. In the illustrated embodiment, five such blasting holes, each about 10 inches in diameter, are in each of two rows parallel to the large side walls of the slot 78. The pattern of ten blasting holes on each side of the slot is similar to the pattern on the other side. The first or inner row of blasting holes 91 is along the roof-supporting pillar 74 on the opposite side thereof from the central drift 70 of the base of operation 25. An outer row of blasting holes 92 is drilled downwardly along a side boundary of the fragmented permeable mass of particles to be formed in the retort site.

Explosive is then loaded into each blasting hole 91 and 92 and is detonated in all of the blasting holes in a single round to form the fragmented permeable mass 10 shown in FIGS. 1 and 2. The blasting holes 91 and 92 are stemmed with inert material over the explosive to minimize overbreak of formation above the level of the explosive. Thus, in the illustrated embodiment, the blasting holes are stemmed from about 40 feet below the floor of the base of operation 25. Detonation of the explosive in the blasting holes for expanding formation toward the slot thereby leaves unfragmented formation as a 40-foot thick horizontal sill pillar 2 between the fragmented permeable mass so formed and the base of operation. The sill pillar has a horizontal extent sufficient to provide effective access to essentially the entire horizontal cross-section of the fragmented mass formed in the retort 10.

According to the present invention, the base of operation 25 is used as a location from which to control gas flow through the fragmented mass. Separate vertical steel casings 32 are disposed in selected blasting holes. A conventional external packer 34 at the lower end of each casing seals against the casing exterior and the adjacent portion of the horizontal sill pillar 22. The annular space between the casing and the sill pillar above the packer is filled with concrete or grout 36 commonly referred to as cement which anchors the casing securely in the sill pillar. In some situations, the casing can be adequately secured by using only the packer, or the cement can be replaced by drilling mud or the like to facilitate removal of the casing after the fragmented oil shale in the retort is completely treated.

The lower end of the casing is above a level in the fragmented mass where a combustion zone is established. Gas in the combustion zone can include carbon monoxide, carbon dioxide, hydrogen sulfide and water vapor. Such gases can be corrosive to steel pipe, particularly at the operating temperatures involved. By limiting the location of the lower ends of the casings to a level above the combustion zone, corrosion of the casings is inhibited.

Although one embodiment of in situ oil shale retort has been described and illustrated herein, many modifications and variations will be apparent to one skilled in the art. Thus, for example, the blower 61 for withdrawing gas from the fragmented mass has been illustrated as if located in an access drift, it will be apparent that such a blower can be located above ground and connected to underground workings for withdrawing gas from a plurality of in situ retorts. In such an embodiment the valves connected to casings in the base of operation can cooperate with or replace gas control systems at the production level for individual retorts. Because of variations such as this, it will be apparent that this invention can be practiced other than as specifically described. Preferably, the lower end of each casing is not below the bottom of the sill pillar to avoid contact with combustion zone gases. In a working embodiment each casing extended through about the top 20 feet of a bore hole through a sill pillar with a total thickness of about 40 feet. Such a length assures adequate support for the casing and sealing of the annulus between the casing and the bore hole.

A casing collar 40 secures an upper section 38 of the casing to the portion of the casing 32 cemented in the sill pillar. A check valve 42 and a throttle valve 44 (shown schematically in FIG. 3) are mounted in the upper section of the casing. An inlet section 46 connected above the throttle valve admits air from the base of operation to the fragmented mass through the throttle valve and the check valve.

An additive line 48 is sealed through the side of the casing below the check valve and throttle valve so that an additive or diluent such as steam, retorting off gas, auxiliary fuel, additional oxygen, particulate combustible matter such as coal, or the like, can be admitted through the casing into the top of the fragmented mass. The admission of additive or diluent is controlled by a valve 50 in the additive line 48. The additive or diluent can be used to adjust the oxygen concentration of gas flowing into the fragmented mass through the casings.

Returning to FIG. 1, a sump 52 in the region of the access drift 18 beyond the fragmented mass collects shale oil 53 and water 54 produced during the operation of the retort. A water withdrawal line 56 extends from near the bottom of the sump out through a sealed opening (not shown) in a vertical barrier or bulkhead 57 sealed across the access drift. The water withdrawal line is connected to a water pump 60. An oil withdrawal line 58 extends from an intermediate level in the sump out through a sealed opening (not shown) in the barrier and is connected to an oil pump 59. The oil and water pumps can be operated manually or by automatic controls (not shown), to remove shale oil and water separately from the sump.

The inlet of a blower 61 is connected by a conduit 62 to an opening 63 through the barrier 57 for withdrawing off gas from the retort. The outlet of the blower delivers off gas from the retort through a conduit 64 to a recovery or disposal system (not shown). Thus, the access drift 18 provides means for collecting and recovering liquid and gaseous products from the in situ oil shale retort. A variety of collection and recovery techniques can be used, some of which are set forth in the prior art.

The void formed in the retort site before explosive expansion is proportioned relative to the formation expanded toward the void, so that after explosive expansion is completed, the retort is filled with fragmented particles containing oil shale which are packed against the lower surface of the horizontal sill pillar 22. This provides support for the bottom of the sill pillar during high temperature retorting operations, and minimizes any tendency of formation to slough from the bottom of the sill pillar.

The blasting holes remaining through the sill pillar 22 after formation of the fragmented mass can be cleaned out, reamed, and/or redrilled, if necessary, after the fragmented mass 10 has been formed. For example, the blasting holes to be used for the casings 30 can be reamed out to about twelve inches in diameter to accomodate larger casings and/or remove a layer from the hole wall which can have some damage from blasting. Other blasting holes not to be used for gas flow to the retort are sealed, such as by filling with concrete.

During retorting operations, the fragmented mass 10 is ignited through the blasting holes to establish a combustion zone across the top of the fragmented mass. Gas flow through each of the casings can be monitored during retorting and separately controlled from the base of operation to control advancement of the combustion zone through the fragmented mass. The combustion zone is advanced downwardly through the fragmented mass by introducing an oxygen containing gas to the fragmented mass through the casings. Hot gases flowing downwardly from the combustion zone decompose kerogen in a retorting zone in the fragmented mass of oil shale particles to produce liquid and gaseous products. The liquid products percolate through the fragmented mass on the advancing side of the retorting zone and accumulate in the sump 52 in the access drift 18, as described above.

The oxygen containing gas introduced through the casings can be fresh air, or air mixed with other gases, liquids and/or particulate matter. Gas flow through the fragmented mass is generated by the blower 61 which produces a lower gas pressure in the access drift 18 then in the base of operation 25. This draws air from the base of operation 25 into the casings and into the fragmented mass. Gas flows down through the fragmented mass to the lower access level drift 18.

The throttle valves 44 on the separate casings provide means for separately controlling the flow of oxygen containing gas from the base of operation into selected regions of the fragmented mass to control advancement of the combustion zone through the fragmented mass. For example, prior to ignition of the fragmented mass, gas flow rate measurements can be conducted to determine the permeability distribution of the particles in the fragmented mass. Such measurements are achieved by generating gas flow across the horizontal cross-sectional extent of the fragmented mass from the top of the fragmented mass to a gas withdrawal point at the bottom of the fragmented mass. The blower 61 in the access drift 18 draws air from the base of operation 25 down through the fragmented mass and out the access drift 18. The rate of flow air through each casing is then measured, preferably by a conventional vane anemometer or hot wire anemometer. To simplify gas flow rate measurements, the throttle valves 44 in the casings are preferably set at the same valve opening so that the cross-sectional area provided through each valve is essentially identical. The anemometer readings are then taken to determine the rate of flow of air through the corresponding casings. Inasmuch as the casings are distributed essentially uniformly across the face of the sill pillar, the flow rate measurements provide a reasonably accurate sampling of the permeability distribution of the formation particles essentially uniformly across the horizontal cross-section of the fragmented mass. A relatively low flow rate measurement indicates relatively low permeability in a portion of the fragmented mass, or possibly unfragmented formation present in a region of the fragmented mass. On the other hand, a relatively higher flow rate measurement indicates a relatively greater tendency for channeling in a vertically extending portion of the fragmented mass, and the magnitude of the flow rate will be substantially directly proportional to the amount of gas channeling.

After the flow rate measurements are conducted for all casings, the throttle valves 44 are adjusted in accordance with the flow rate measurements to adjust the volume of gas for retorting introduced through each casing. The gas flow adjustments are made by increasing throttle valve area in inverse proportion to the magnitude of the measured flow rate. Thus, in those bore holes corresponding to relatively higher gas flow rates, the throttle valves are adjusted to provide a relatively lower gas flow volume to the fragmented mass; and in those bore holes corresponding to relatively lower gas flow rates, the valves are adjusted to provide a relatively greater gas flow volume to the fragmented mass. The valves are adjusted in relation to one another to produce an essentially uniform gas flow distribution across the horizontal cross-section of the fragmented mass from its top to its bottom. As described above, this will tend to minimize the effects of channeling by equalizing the rate of gas flow through the fragmented mass and tend to produce an essentially flat and horizontal advancing combustion zone through the fragmented mass.

After the throttle valves have been adjusted in accordance with the gas flow rate measurements, the retort is ready for inlet gas to be introduced through the casings for use in sustaining and advancing a combustion zone through the retort. Hot gases flowing downwardly from the combustion zone decompose kerogen in the fragmented mass of oil shale particles to produce liquid and gaseous products. The liquid products percolate through the fragmented mass on the advancing side of the retorting zone and accumulate in the sump 52 in the access drift 18, as described above.

If one or more portions of the fragmented mass are detected as being more permeable than another portion or other portions, resulting in non-uniform burning in the fragmented mass, or if it is found that the locus of the combustion zone is undesirable, the relative flow of gas through the various casings can be adjusted independently of one another by using the separate throttle valves. This can provide a desired gas flow gradient through the fragmented mass which can result in producing a combustion zone which is substantially flat and horizontal as it advances through the retort.

If a combustion zone is not properly advanced through the fragmented mass, the combustion zone can become skewed and/or warped. It is desirable to establish and maintain a combustion zone which is flat and uniformly transverse to the direction of its advancement to maximize yield of hydrocarbon products from oil shale in an in situ oil shale retort. If the combustion zone is skewed relative to its direction of advancement, there is more tendency for oxygen present in the combustion zone to migrate into the retorting zone, thereby oxidizing the hydrocarbon products produced in the retorting zone and reducing hydrocarbon yield. In addition, with a skewed and/or warped combustion zone, excessive cracking of hydrocarbon products produced in the retorting zone can result.

By providing means for separately controlling gas flow to selected regions throughout the horizontal cross-section of the fragmented mass, the present invention facilitates advancing a combustion zone which is essentially flat and transverse to its direction of advancement.

Further, by using the base of operation as a plenum chamber for admission of air to the fragmented mass, all of the air introduced into the fragmented mass is drawn from the base of operation and passageways connecting it to the surface, thereby adding to the fresh air supply in those working areas.

Moreover, by using the blower 61 as the means for drawing gas through the fragmented mass from the base of operation, gas pressure within the fragmented mass is reduced relative to gas pressure within the base of operation 25 mass. This inhibits leakage of off gas from the fragmented mass into the base of operation and its surrounding underground workings. Inasmuch as off gas from the fragmented mass can contain a substantial amount of hydrogen sulfide and carbon monoxide, such off gas would otherwise pose a potential hazard to operating personnel in the base of operation and other underground workings.

The check valve in each casing prevents inadvertent back flow of retorting gases into the base of operation if the blower 61 withdrawing gas from the fragment mass is temporarily shut down. There can be continued production of gas in the fragmented mass even when the blower 61 is not operating due to high temperatures which can cause further retorting. This can cause a gas pressure increase in the fragmented mass beneath the sill pillar 22 which could result in a gas pressure higher than that in the base of operation. Reverse flow of gas is inhibited by the check valves 42 in the casings which permit gas to flow into the fragmented mass from the base of operation while preventing reverse flow.

What is claimed is:

1. Means for recovering liquid and gaseous products from a subterranean formation containing oil shale comprising:

an in situ oil shale retort containing a fragmented permeable mass of formation particles containing oil shale;

an open base of operation in unfragmented formation at a level above a top boundary of the fragmented mass for providing access over substantially the entire horizontal cross section of the fragmented mass;

a plurality of bore holes extending through unfragmented formation between the base of operation and the top boundary of the fragmented mass, the bore holes opening into the base of operation and into an upper portion of the fragmented mass;

a separate casing sealed in each of a plurality of such bore holes, the upper end of each casing opening into the base of operation, the lower end of each casing opening into an upper portion of the fragmented mass;

valve means connected to each of such casings in the base of operation for separately controlling the flow of gas through such casings from the base of operation; and means for introducing an oxygen-containing gas to the fragmented mass through a plurality of such casings for sustaining a combustion zone in the fragmented mass and for advancing the combustion zone through the fragmented mass.

2. Apparatus according to claim 1 wherein the bottom of such a casing is in a bore hole in unfragmented formation above the top boundary of the fragmented mass.

3. Apparatus according to claim 1 in which the casings are cemented in the bore holes with concrete.

4. Apparatus according to claim 1 including a means for access in the formation adjacent a bottom boundary of the fragmented mass, and means for producing a lower gas pressure in the means for access than in the base of operation for drawing gas from the base of operation through the bore holes into the fragmented mass for advancing the combustion zone through the fragmented mass.

5. Apparatus according to claim 1 including a check valve on each of such casings to permit gas to flow through such casings from the base of operation into the fragmented mass and to prevent gas from flowing through such casings from the fragmented mass into the base of operation.

6. Apparatus according to claim 5 including means for withdrawing gas from the fragmented mass adjacent a bottom boundary of the fragmented mass for drawing gas from the base of operation through the casings into the fragmented mass for advancing the combustion zone downwardly through the fragmented mass.

7. Apparatus according to claim 1 including an additive conduit connected to such a casing for adjusting the composition of gas flowing through such casing.

8. Means for retorting oil shale in an underground formation containing oil shale comprising:

an open base of operation excavated in an upper level of the formation;

a means for access excavated to a lower level of the formation beneath the base of operation;

an in situ oil shale retort containing a fragmented permeable mass of particles containing oil shale, said fragmented mass being formed beween the means of access and an elevation spaced apart from and below the base of operation, leaving a horizontal sill pillar of unfragmented formation between the top of the fragmented mass and the bottom of the base of operation for effective access to substantially the entire horizontal cross-section of the fragmented mass;

a plurality of vertically extending bore holes formed through the sill pillar and distributed across the horizontal cross-section of the fragmented mass and opening into the base of operation;

a separate casing sealed in each of a plurality of the bore holes, the upper end of each casing opening into the base of operation; the lower end of each casing opening into an upper portion of the fragmented mass;

valve means connected to each of such casings in the base of operation for separately controlling the flow of gas from the base of operation through such casings; and means for producing a lower gas pressure in the means for access than in the base of operation for drawing gas from the base of operation through such bore holes into the fragmented mass for advancing a combustion zone through the fragmented mass.

9. Apparatus according to claim 8 including means cementing each casing in the bore holes.

10. Apparatus according to claim 8 including an additive conduit connected to such a casing for adjusting the composition of gas flowing through such casing.

11. Apparatus according to claim 8 including a check valve connected to each of such casings to permit gas to flow through such casing from the base of operation into the fragmented mass and to prevent gas from flowing through such casings from the fragmented mass into the base of operation.

12. Apparatus according to claim 8 wherein the bottom of such a casing is in a bore hole in unfragmented formation above the top boundary of the fragmented mass.

13. Means for retorting oil shale in situ in a subterranean formation containing oil shale comprising:

an in situ oil shale retort containing a fragmented permeable mass of formation particles containing oil shale;

a means for access through the formation to a lower portion of the fragmented mass;

an open base of operation in the formation at an elevation above the top of the fragmented mass, at least a portion of the base of operation being directly above the fragmented mass;

a horizontal sill pillar of unfragmented formation between the top of the fragmented mass and the bottom of the base of operation;

a plurality of bore holes extending through the sill pillar from the base of operation to the fragmented mass;

means for generating a lower gas pressure in the means for access than in the base of operation to draw gas from the base of operation through the bore holes and into the fragmented mass;

a separate casing disposed in each of a plurality of such bore holes, and a seal between the exterior of each casing and the sill pillar, the upper ends of such casings opening into the base of operation; and the lower ends of such casings opening into an upper portion of the fragmented mass;

valve means connected to each of such casings for separately controlling gas flow through the casings; and a check valve on at least a portion of such casings to permit gas to flow through such casings from the base of operation into the fragmented mass and to prevent gas from flowing through such casings from the fragmented mass into the base of operation.

14. Apparatus according to claim 13 wherein the bottom of such a casing is in a bore hole in unfragmented formation above the top boundary of the fragmented mass.

15. A method of retorting oil shale in an in situ oil shale retort in a subterranean formation containing oil shale, such as in situ oil shale retort containing a fragmented permeable mass of particles containing oil shale, said fragmented mass having top, bottom and side boundaries, the method comprising the steps of:

excavating a first portion of formation to form an open base of operation at an elevation in the formation above the top boundary of the fragmented mass being formed;

excavating a second portion of formation for forming at least one void within the boundaries of the fragmented mass being formed;

drilling from the base of operation a plurality of bore holes in a third portion of the formation below the base of operation;

loading explosive into such blasting holes only up to an elevation lower than the bottom of the base of operation;

detonating such explosive to expand the third portion of formation toward such a void to form a fragmented permeable mass of particles containing oil shale and to leave a horizontal sill pillar of unfragmented formation between the top of the fragmented mass and the bottom of the base of operation;

sealing a separate casing in each of a plurality of such bore holes, the upper end of each casing opening into the base of operation, the lower end of such a casing opening into an upper portion of the fragmented mass;

connecting valve means to each of such casings in the base of operation for separately controlling the flow of gas through such casings from the base of operation;

establishing a combustion zone in an upper portion of the fragmented mass below the lower ends of such casings; and introducing an oxygen-containing gas to the fragmented mass through a plurality of such casings for sustaining the combustion zone in the fragmented mass and for advancing the combustion zone through the fragmented mass.

16. The method according to claim 15 including sealing the casings in their respective blasting holes after detonation of such explosive.

17. The method according to claim 15 including withdrawing gas from the fragmented mass adjacent the bottom boundary of the fragmented mass for drawing gas from the base of operation through the casings into the fragmented mass for advancing the combustion zone downwardly through the fragmented mass.

18. The method according to claim 15 including connecting a check valve on each of such casings to permit gas to flow through such casings from the base of operation into the fragmented mass and to prevent gas from flowing through such casings from the fragmented mass into the base of operation.

19. A method for retorting oil shale in an in situ oil shale retort in a subterranean formation containing oil shale, such as in situ oil shale retort containing a fragmented permeable mass of formation particles containing oil shale, said fragmented mass having top, bottom and side boundaries, the method comprising the steps of:

excavating a first portion of formation to form an open base of operation at an elevation in the formation above the top boundary of the fragmented mass being formed;

excavating a means of access through a second portion of the formation to a location underlying the base of operation;

excavating a third portion of formation for forming at least one void within the boundaries of the fragmented mass being formed;

drilling from the base of operation a plurality of bore holes in a third portion of the formation below the base of operation;

loading explosive into the bore holes only up to an elevation lower than the bottom of the base of operation;

detonating such explosive to expand the third portion of formation toward such a void to form a fragmented permeable mass of particles containing oil shale within said top, bottom and side boundaries, leaving a horizontal sill pillar of unfragmented formation between the top boundary of the fragmented mass and the bottom of the base of operation;

sealing a separate casing in each of a plurality of the bore holes, the upper end of such casing opening into the base of operation, the lower end of such casing opening into an upper portion of the fragmented mass;

connecting valve means to each of such casings in the base of operation for separately controlling the flow of gas through such casings from the base of operation;

establishing gas flow through the plurality of casings into the fragmented mass;

measuring the rate of flow of gas through such casings; and adjusting selected valve means to adjust the rate of flow of gas through selected casings to provide a selected distribution of gas flow through the fragmented mass.

20. The method according to claim 19 including igniting the fragmented mass to establish a combustion zone in an upper portion of the fragmented mass after adjusting the rate of flow of gas through the casings.

21. The method according to claim 19 including measuring the gas flow rate in each casing by a gas flow rate sensor located in the base of operation.

22. The method according to claim 19 including producing a lower gas pressure in the means of access than in the base of operation for drawing gas from the base of operation down through the casings and into the fragmented mass.

23. The method according to claim 19 including connecting a check valve on each of such casings to permit gas to flow through such casings from the base of operation into the fragmented mass and to prevent gas from flowing through such casings from the fragmented mass into the base of operation.

* * * * *

UNITED STATES PATENT AND TRADEMARK OFFICE

CERTIFICATE OF CORRECTION

PATENT NO. : 4,118,070

DATED : October 3, 1978

INVENTOR(S) : Gordon B. French, Richard D. Ridley

It is certified that error appears in the above-identified patent and that said Letters Patent are hereby corrected as shown below:

Column 2, line 18, "new" should be deleted after "the" and before "formation".
Column 4, line 35, "exlosive" should be -- explosive --.
Column 5, line 16, "evcavation" should be -- excavation --.
Column 6, line 24, "Formaion" should be -- Formation --;
Column 6, line 56, "roof-suppoting" should be --roof-supporting-
Column 7, line 43, "2" should be -- 22 --.
Column 8, lines 5 through 18 should be deleted;
Column 8, line 31, "3" should be -- 4 --.
Column 10, line 6, "essentially uniformly" should be deleted.
Column 11, line 24, "mass" should be deleted;

UNITED STATES PATENT AND TRADEMARK OFFICE

CERTIFICATE OF CORRECTION

PATENT NO. : 4,118,070

DATED : October 3, 1978

INVENTOR(S) : Gordon B. French, Richard D. Ridley

It is certified that error appears in the above-identified patent and that said Letters Patent are hereby corrected as shown below:

Column 11, line 44, insert the following:
-- Although one embodiment of in situ oil shale retort has been described and illustrated herein, many modifications and variations will be apparent to one skilled in the art. Thus, for example, the blower 61 for withdrawing gas from the fragmented mass has been illustrated as if located in an access drift, it will be apparent that such a blower can be located above ground and connected to underground workings for withdrawing gas from a plurality of in situ retorts. In such an embodiment the valves connected to casings in the base of operation can cooperate with or replace gas control systems at the production level for individual retorts. Because of variations such as this, it will be apparent that this invention can be practiced other than as specifically described. --

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*